US005947596A

United States Patent [19]

Dowd

[11] Patent Number: 5,947,596

[45] Date of Patent: Sep. 7, 1999

[54] DRY POWDER BATCH ACTIVATION SYSTEM

[75] Inventor: Walter O'Dowd, Bradley, Ill.

[73] Assignee: U.S. Filter/Stranco

[21] Appl. No.: 08/872,355

[22] Filed: Jun. 10, 1997

[51] Int. Cl.[6] ..... B01F 7/00

[52] U.S. Cl. ..... 366/152.6; 366/163.2; 366/241

[58] Field of Search ..... 366/152.6, 153.1, 366/154.1, 163.1, 163.2, 167.1, 174.1, 175.2, 182.1, 182.2, 182.3, 184, 336, 241

[56] References Cited

U.S. PATENT DOCUMENTS

| | | | |
|---|---|---|---|
| 4,051,065 | 9/1977 | Venema | 366/154.1 |
| 4,210,166 | 7/1980 | Ricciardi | 366/154.1 |
| 4,640,622 | 2/1987 | Sortwell | 366/167.1 |
| 4,664,528 | 5/1987 | Rodgers et al. | 366/336 |
| 4,773,764 | 9/1988 | Colombani et al. | 366/153.1 |
| 4,778,280 | 10/1988 | Brazelton | 366/136 |
| 4,779,186 | 10/1988 | Handke et al. | 366/153.1 |
| 4,830,505 | 5/1989 | Dunton et al. | 366/138 |
| 4,836,685 | 6/1989 | Verreault | 366/153.1 |
| 5,018,871 | 5/1991 | Brazelton et al. | 366/168 |
| 5,135,968 | 8/1992 | Brazelton et al. . | |
| 5,190,374 | 3/1993 | Harms et al. | 366/175.2 |
| 5,222,807 | 6/1993 | Graddis | 366/153.1 |
| 5,288,145 | 2/1994 | Mackey et al. | 366/153.1 |
| 5,344,619 | 9/1994 | Larwick et al. | 366/163.2 |
| 5,382,411 | 1/1995 | Allen | 366/153.1 |
| 5,544,951 | 8/1996 | Alack | 366/163.2 |
| 5,642,939 | 7/1997 | Comardo | 366/163.2 |
| 5,779,355 | 7/1998 | Pullman | 366/163.2 |

*Primary Examiner*—Tony G. Soohoo
*Attorney, Agent, or Firm*—McHale & Slavin, PA

[57] ABSTRACT

A system for mixing dry powder and water having a non-pressurized make-up reservoir (10). The make-up water is transferred by a booster pump (14) through a transfer pipe (20) at a predetermined flow rate and pressure for operation of a dry powder eductor (26) fed through powder hopper (28). The educted powder is instantly wetted through an area causing a high shear environment (25). A solution mix tank (32) is placed within the reservoir tank (10) having a turbine mixer (40) for maintaining the polymer solution in a uniform state. The mixed solution is maintained at a predetermined level and is available for transfer through discharge port (50) in batch, upon demand.

21 Claims, 2 Drawing Sheets

DRY POWDER BATCH ACTIVATION SYSTEM

FIELD OF THE INVENTION

A dry powder batch activation system for the automatic mixing of dry powder into a concentrated solution for liquified insertion into a water treatment system.

BACKGROUND OF THE INVENTION

Chemical feeders are commonly used throughout the water treatment industry for insertion of a concentrated solution to treat a particular attribute. For instance, a chelant may be used to control scaling by forming heat stable soluble complexes with calcium and magnesium; sodium sulfite may be used to prevent oxygen corrosion; polymers may be used to disperse sludge or aid in the removal of undesirable particles.

Most water treatment chemicals are inserted in a concentrated form by use of a liquid chemical feeder. The chemical feeder injects a predetermined amount of the concentrated chemical from a solution tank. The solution tank may consist of a premixed solution or be used as a make-up tank where a dry powder is admixed with water to form the concentrated solution. For explanation purposes only, the focus of this application is directed to polymers which are tightly tangled structures before activation and become untangled and activated upon proper dilution with water.

One such polymer, known as polyelectrolytes, are high molecular-weight polymers used for, among other things, an aid in removing suspended particles from water, for dewatering sludges, and for other liquid-solid separation applications. This polymer is typical of dry powder chemicals wherein proper mixing is required to cause activation without damaging of the chemical structure.

The use of premixed polymers are relatively expensive. Premixed polymers are shipped as a concentrated liquid in drums, the drums are difficult to handle and liquid has a limited shelf life. Depending upon the type of polymer, additional mixing to maintain the polymer in solution or transfer to a solution tank having a greater dilution may be necessary. Spillage of a liquid polymer presents a hazardous situation for liquid polymer creates an extremely slippery surface.

Dry polymer is desirable for many applications because it can be easily stored and shipped. A dry powder is relatively light and if spilled can be easily recovered. Dry polymers are permissible for certain food grade and potable applications, whereas premixed liquid polymers are not, as it is difficult to control bacteria in a liquid carrier. The problem with dry polymers is the need for mixing with water before use.

Typically dry powder is placed into a solution tank and diluted with water where it is mixed by hand or by use of an electric mixer. Dry polymers are hygroscopic and its suspension in water is thixotropic. For this reason, known systems for purposes of mixing dry polymers with water are subject to agglomeration of dry polymer particles during the wetting procedure. For this reason, a dry polymer must be mixed correctly or improper concentrations will be formed causing difficulty in the water treatment process as well as feeder problems. Point of use mixing frequently fails to properly mix dry polymers which require a shear mix that is sufficient to cause proper wetting but not high enough to damage the polymer structure. Further, the polymer must be maintained in solution requiring constant mixing, again without damaging the polymer structure.

The assignee has developed many devices in this area to address this situation. For instance, U.S. Pat. No. 4,778,280 discloses a device for mixing dry polymer with a liquid. The device consists of a pump having a centrifugal impeller with a means for inserting a predetermined amount of polymer and liquid into the suction side of the impeller allowing the impeller to admix the solution. U.S. Pat. No. 5,018,871 discloses a polymer dilution and activation apparatus also having a polymer and water intake placed adjacent to the pump impeller allowing instantaneous mixing through high shear forces which discourages the polymer from forming gel aggregates.

U.S. Pat. No. 5,135,968 provides a primary dilution and activation apparatus having a predefined chamber capable of mixing the polymer and liquid in a processing zone which subjects the polymer to relatively high shear conditions for a relatively short period of time in one zone, and subjects the solution to a continuously decreasing shear rate for a longer period of time in the second zone.

What is lacking in the art is a low maintenance automatic dry powder batch activation system for the mixing of dry powder into a concentrated solution for liquified insertion into a water treatment system.

SUMMARY OF THE INVENTION

The instant invention is a dry powder batch activation system for the mixing of dry powder into a concentrated solution allowing for liquified insertion into a water treatment system. The system employs a non-pressurized water reservoir tank having a float valve for maintaining a predetermined fluid level. A solution mix tank is placed within the water reservoir tank which minimizes the footprint of the system, provides an insulator for the solution mix tank, maintains the solution mix tank at the same water temperature as the water reservoir tank, and operates as a catch basin for solution spillage.

The solution mix tank, as will be described later in this invention, includes a mixer to maintain the polymer in a mixed solution without shearing of polymer molecules. In operation, a pump draws water from the reservoir tank and boosts the water to a predetermined pressure and flow rate. The pump transfers the water past an eductor wherein a dry powder feeder is used to insert polymer into the eductor and maintain a constant pressurized flow into the eductor. The eductor inserts the dry powder into the water where it is subjected to a momentary high shear environment before delivery to a solution mix tank. A mixer placed within the solution mix tank has a preferred impeller-to-tank ratio of 50 percent and a shaft speed of approximately 120 rpms to maintain the polymer solution in a uniform state without causing damage to the polymer structure.

The booster pump operates at the beginning of a batch sequence caused by a level differentiation within the solution mix tank. When the level in the solution mix tank drops to a predetermined level, the booster pump will operate for approximately 30 seconds to provide an initial system flush before the powder is educted. The initial flush removes any residual from a previous batch as well as causes the eductor to operate at the preferred level. The powder feeder runs for a period of time providing the required powder eduction. A potentiometer allows rate adjustment to insure that the powder and water are fed at a proper ratio. The booster pump will continue to flow until the solution mix tank reaches a high level thereby flushing the system of any residual polymer.

Thus, an objective of the instant invention is to teach a dry powder batch activation system that is automatic and provides consistent polymer solution batch mixtures without causing shear damage to the polymer.

Still another object of the instant invention is to provide a constant and predictable flow rate past a dry powder eductor, thereby providing a predictable polymer insertion into a high shear environment for optimum polymer wetting.

Another object of the instant invention is to provide a low shear uniform solution mix tank having a mixing impeller to tank ratio of approximately 50 percent to maintain the polymer mixture in solution without damage to the polymer structure.

Yet another objective of the instant invention is to provide a portable self contained dry powder batch activation system having a small skid footprint.

Yet another objective of the instant invention is to place the solution mix tank within the raw water reservoir tank which operates to control spillage, maintains the solution at the same temperature as the raw water reservoir tank, and allows for a reduced skid size.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
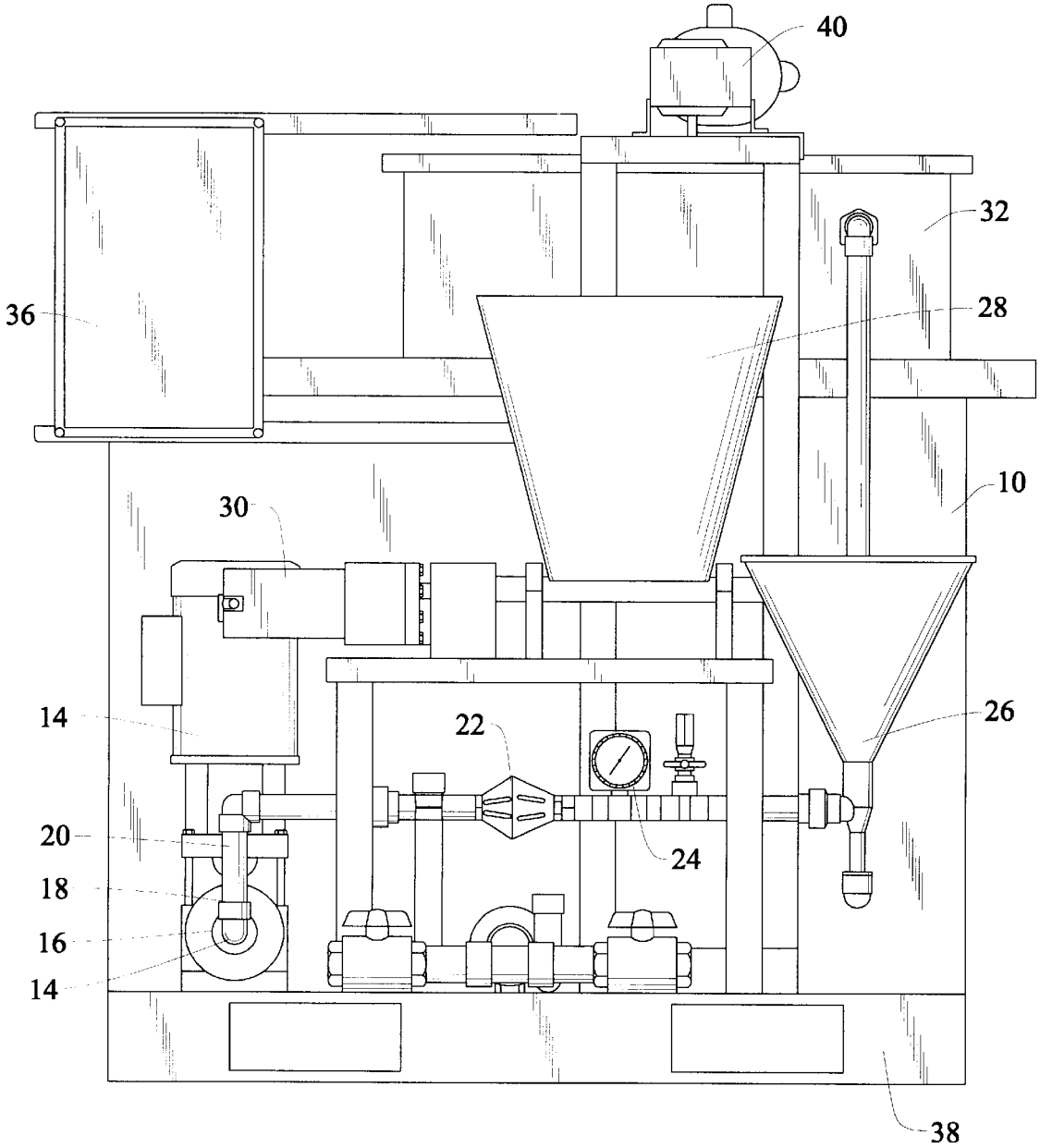
FIG. 1 is a plane side view of the system of the instant invention.
Figure 2:
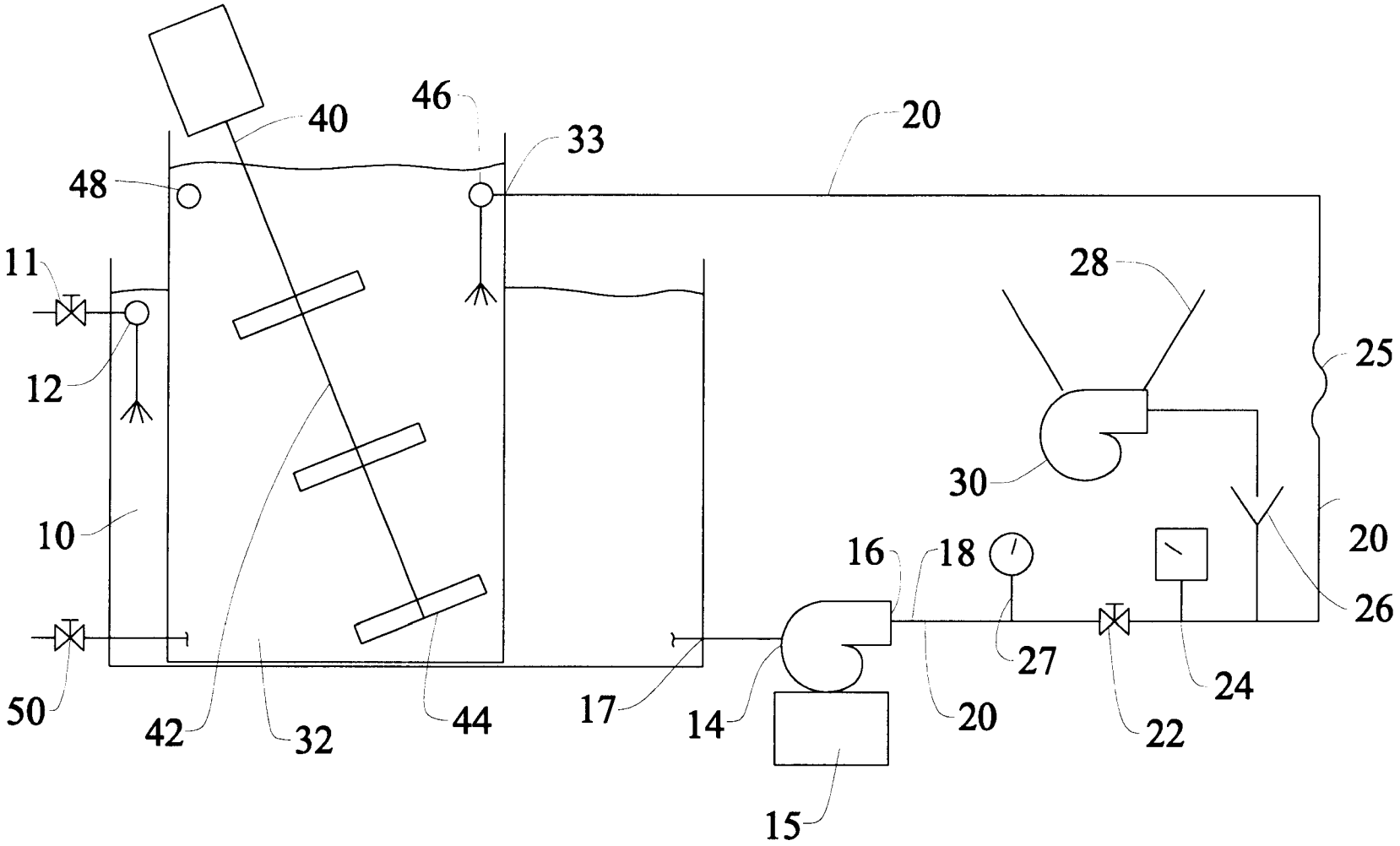
FIG. 2 is a flow diagram of the instant invention.

Although the invention will be described in terms of a specific embodiment, it will be readily apparent to those skilled in this art that various modifications, rearrangements and substitutions can be made without departing from the spirit of the invention. The scope of the invention is defined by the claims appended hereto. The specific embodiment provides a 150 gallon batch production of polymer solution.

Referring now in general to the Figures, set forth is the system of the instant invention for mixing dry polymer and water at a predictable concentration, and further holding the mixed solution as a batch solution until transfer is required. The system consists of a tank-in-a-tank arrangement with a make-up reservoir 10 being approximately a 260 gallon liquid storage container with an inlet 11 for coupling to a water supply. The level in the reservoir 10 is maintained by use of float valve 12 which opens the raw water line to the reservoir 10 when the water in the reservoir drops below a predetermined set point, thereby automatically maintaining a high level of water in the reservoir.

A centrifugal pump 14 having an electric motor drive 15 draws the water from the outlet 17 of reservoir 10. In this manner, the reservoir 10 operates as a make-up tank wherein the pump 14 draws from the non-variable unpressurized water supply held in the reservoir 10 allowing the pump to repressurize at a predetermined flow rate of 15 gpm at a pressure of 70 psi. The pressurized water is directed through the discharge end 16 of the pump 14 into the proximal end 18 of a transfer pipe 20. The flow rate is preferably factory set by use of a throttling valve 22 which can be monitored by a flow meter 24 and pressure gauge 27.

Dry polymer is inserted into the transfer pipe 20 by use of an eductor 26 before a high shear environment area 25. The dry polymer is fed into the eductor 26 upon demand by use of powder hopper 28. In this embodiment the dry feeder holds approximately 1.4 cubic feet of dry powder available for transfer by the feeder 30. The insertion of the polymer into a high shear environment area 25 which causes instant mixing of the material into a wetted solution. In this manner, the polymer is wetted quickly and completely without damaging the polymer molecules. The high shear environment area 25 is maintained for a relatively short length and contact time after which the solution is delivered to the solution mix tank 32.

The solution mix tank in this embodiment is about 150 gallons and is coupled to the distal end 33 of the transfer pipe 20 for receipt of the mixed solution. The solution mix tank 32 is placed within the reservoir tank 10 providing a tank-in-a-tank small footprint system. The placement of the tank 32 provides overflow protection, for instance, should the solution mix tank 32 overflow, the mixed solution will spill into the reservoir. This is especially important as a wetted polymer provides for an extremely slippery surface. Should the solution mix tank level control fail, the overflow will simply return to the reservoir tank where it will continue recirculating until the problem corrected. Positioning the solution tank within the reservoir tank also maintains the solution at the same temperature as the water in the reservoir tank. In this manner, should excess solution recirculation occur, the reservoir tank will dissipate the excess heat from the solution tank.

The polymer solution is maintained in a low shear environment by use of a turbine mixer 40 having an impeller-to-tank ratio of about 50 percent. The mixer includes three impellers 44 spaced apart along a longitudinal shaft 42 and rotated at about 120 rpm. A level control 46 is disposed in the solution mix tank and is electrically coupled to the pump 14, the level control 46 maintaining the solution at a preset level. The powder feed duration is controlled by an adjustable timer. Powder feed rate is controlled by a potentiometer 48. The timer and potentiometer are located in a control panel. The mixed solution may be discharged through outlet 50 upon demand.

The system allows for flushing before and after the transfer of polymer. The pump 14 operates for approximately thirty seconds before operation of the dry chemical feeder 30. The start-up allows the eductor 26 to be cleaned and the eduction process to be optimized so that a predictable amount of polymer is inserted. Once the amount of polymer is inserted, the pump 14 continues to operate for about thirty seconds to flush the eductor 26 and transfer pipe 20 clean.

The system includes a master control panel 36 and all components are mounted on a single skid 38 having a footprint of about 48 inches wide and about 72 inches long. The system for activating polymer in water may be interpreted according to the following steps:

(a) filling an unpressurized reservoir with water and maintaining a level of water in said reservoir;

(b) transferring said water from said reservoir to a solution mix tank through a transfer pipe;

(c) inserting a dry polymer into said transfer pipe in a high shear environment forming a mixed solution;

(d) mixing said mixed solution in said solution mix tank forming a low shear environment, monitoring the mixed solution level in said solution mix tank wherein a low level causes said transferring of water and a high level stops said transferring of water; and (e) delivering said mixed solution upon demand.

The method may include the step of flushing the transfer pipe for a predetermined period of time before the insertion of polymer and for a predetermined period of time after the insertion of polymer.

It is to be understood that while a specific embodiment of the invention is described including tank sizes and flow rates, the invention is not to be limited to the specific sizes, forms or arrangement of components herein described and shown. It will be apparent to those skilled in the art that various changes may be made without departing from the scope of the invention and the invention is not to be considered limited to what is shown in the drawings and described in the specification.

What I claim is:

1. A system for mixing dry powder and water, said system comprising:

(a) a reservoir having an inlet and an outlet, said inlet available for coupling to a water supply;

(b) means for automatically maintaining a level of water in said reservoir;

(c) a booster pump having a suction end fluidly coupled to said outlet of said reservoir and a discharge end coupled to a proximal end of a transfer pipe, said pump transferring water through said pump discharge end into said transfer pipe at a predetermined flow rate and pressure, said transfer pipe constructed and arranged to provide instant mixing by producing a high shear environment;

(d) means for inserting dry powder into the water in said transfer pipe where it is subjected to a momentary high shear environment at a metered rate forming a solution;

(e) a solution mix tank, positioned inside said reservoir and coupled to a distal end of said transfer pipe for receipt of said solution;

(f) means for uniform mixing of said solution in said solution mix tank; and (g) a level control disposed in said solution mix tank and electrically coupled to said booster pump, said level control maintaining said solution in said solution mix tank at a preset level, wherein said mixed solution is available for transfer in batch open demand.

2. The system according to claim 1 wherein said booster pump is operatively associated with said means for inserting dry powder to create a high shear environment upon insertion of the dry powder, whereby said high shear environment operates to readily mix said dry powder in said water to form a uniform solution.

3. The system according to claim 1 wherein said means for inserting dry powder is an eductor.

4. The system according to claim 3 wherein said eductor includes a dry particulate feeder coupled to said eductor for transfer of powder thereto.

5. The system according to claim 1 wherein said means for uniform mixing is defined as a turbine tank mixer having an impeller-to-tank ratio of about 50 percent or larger.

6. The system according to claim 5 wherein said tank mixer includes at least two large diameter impellers spaced apart and rotated at about 120 rpm's for low shear mixing.

7. The system according to claim 1 wherein said booster pump includes a means for controlling the flow rate of said water past said means for inserting dry powder.

8. The system according to claim 1 including a means for sensing the ratio of dry powder to water; and means responsive to said sensed ratio being above a threshold for stopping the flow of dry powder.

9. The system according to claim 1 including a means for flushing said transfer pipe.

10. A system for mixing dry polymer and water, said system comprising:

(a) a reservoir having an inlet and an outlet, said inlet available for coupling to a water supply;

(b) a float valve secured to said inlet, said float valve automatically maintaining a level of water in said reservoir;

(c) a booster pump having a suction end fluidly coupled to said outlet of said reservoir and a discharge end coupled to a proximal end of a transfer pipe, said pump transferring water through said pump discharge end into said transfer pipe at a predetermined flow rate and pressure, said transfer pipe constructed and arranged to provide instant mixing by producing a high shear environment;

(d) an eductor for inserting dry polymer into the water in said transfer pipe where it is subjected to a momentary high shear environment at a metered rate forming a solution;

(e) a means for controlling the flow rate of said water transferred through said transfer pipe;

(f) a solution mix tank, positioned inside said reservoir and coupled to a distal end of said transfer pipe for receipt of said solution;

(g) a mixer means disposed in said tank for mixing for maintaining said solution in a uniform solution state; and (h) a level control disposed in said solution tank and electrically coupled to said booster pump, said level control maintaining said solution at a preset level, wherein said mixed solution is available for transfer in batch upon demand.

11. The system according to claim 10 wherein said eductor is coupled to a dry polymer feeder.

12. The system according to claim 10 wherein said mixer is further defined as a turbine mixer having an impeller-to-tank ratio of about 50 percent.

13. The system according to claim 12 wherein said mixer includes three impellers spaced apart along a longitudinal shaft and rotated at about 120 rpm's.

14. The system according to claim 10 including a means for sensing the ratio of dry polymer to water; and means responsive to said sensed ratio being above a threshold for stopping the flow of dry polymer.

15. The system according to claim 10 including a means for flushing said transfer pipe for a predetermined period of time before the insertion of dry polymer and for a predetermined period of time after the insertion of dry polymer.

16. The system according to claim 10 wherein said reservoir tank is about 260 gallons.

17. The system according to claim 10 wherein said solution mix tank is about 150 gallons.

18. The system according to claim 10 wherein said system is mounted on a single skid having a width of about 48 inches and a length of about 72 inches.

19. A method for activating polymer in water comprising the steps of:

(a) filling an unpressurized reservoir with water and maintaining a level of water in said reservoir;

(b) positioning a solution tank within said unpressurized reservoir;

(c) transferring said water from said reservoir to said solution tank through a transfer pipe;

(d) inserting a dry polymer into said transfer pipe in a high shear environment forming a mixed solution;

(e) recirculating said mixed solution in said solution tank forming a low shear environment, monitoring the mixed solution level in said solution tank wherein a low level causes said transferring of water and a high level stops said transferring of water; and (f) delivering said mixed solution upon demand.

20. The method for activating polymer in water according to claim 19 including the step of flushing the transfer pipe for a predetermined period of time before the insertion of polymer.

21. The method for activating polymer in water according to claim 19 including the step of flushing the transfer pipe for a predetermined period of time after the insertion of polymer.

* * * * *